US007413783B2

(12) United States Patent
Sogabe et al.

(10) Patent No.: US 7,413,783 B2
(45) **Date of Patent: *Aug. 19, 2008**

(54) INTERMEDIATE TRANSFER SHEET

(75) Inventors: Jun Sogabe, Osaka (JP); Tadamichi Yamano, Osaka (JP)

(73) Assignee: Fujicopian Co., Ltd., Osaka-Shi, Osaka-Fu (JP)

( * ) Notice: Subject to any disclaimer, the term of this patent is extended or adjusted under 35 U.S.C. 154(b) by 382 days.

This patent is subject to a terminal disclaimer.

(21) Appl. No.: 11/198,859

(22) Filed: Aug. 8, 2005

(65) Prior Publication Data

US 2007/0031616 A1 Feb. 8, 2007

(51) Int. Cl.
*B41M 5/42* (2006.01)

(52) U.S. Cl. ..... 428/32.51; 428/32.69; 428/32.72

(58) Field of Classification Search ..... None
See application file for complete search history.

(56) References Cited

U.S. PATENT DOCUMENTS 7,008,692 B2 * 3/2006 Usuki et al. ..... 428/331

FOREIGN PATENT DOCUMENTS

JP 10-297122 11/1998

* cited by examiner

*Primary Examiner*—Bruce H Hess
(74) *Attorney, Agent, or Firm*—Antonelli, Terry, Stout & Kraus, LLP.

(57) ABSTRACT

An intermediate transfer sheet for use in an intermediate transfer type thermal transfer recording method is disclosed which comprises a support, and at least a protective layer and a receptive/adhesive layer laminated on the support in this order, the protective layer comprising as a main component by weight an acryl-silica hybrid resin curable by irradiation with an ionizing radiation.

4 Claims, No Drawings

INTERMEDIATE TRANSFER SHEET

BACKGROUND OF THE INVENTION

The present invention relates to an intermediate transfer sheet. More particularly, the invention relates to an intermediate transfer sheet for use in an intermediate transfer type thermal transfer recording method wherein an ink image is first formed on the intermediate transfer sheet by a thermal transfer method using a thermal transfer sheet and the ink image on the intermediate transfer sheet is then transferred onto a final image receptor including resin shaped articles such as cards (e.g. identification card), CD-Rs, and plates by a thermal transfer method using a thermal transfer printer equipped with a thermal head, a hot roller, or a hot press. In the present specification, the transfer of the ink image on the intermediate transfer sheet onto the final image receptor is sometimes referred to as "retransfer".

Images formed on identification cards (ID cards) such as credit cards and membership cards by a melt-transfer type thermal transfer method are frequently required to have high level durability. In the conventional intermediate transfer type thermal transfer recording method, there has been adopted a method wherein an intermediate transfer sheet having a protective layer is used to improve the durability of the image on the final receptor (see patent reference 1). Thermoplastic resins having good durability such as acrylic resins are used in the protective layer. When a durability better than that of the thermoplastic resins is required, a method wherein the protective layer is composed of a thermosetting resin is used. Generally the curing of the protective layer is conducted by using heat or ionizing radiation. In the case of curing with heat, the protective layer is previously cured in a state wherein it is present in an intermediate transfer sheet because the heat curing usually needs a long period time and the heat curing of the protective layer after being transferred results in degradation in easiness of the system. Further the heat curing after the transfer frequently causes drawbacks such as heat deformation of image bearing articles.

In the case of curing using ionizing radiation, the protective layer may be cured either before or after the transfer from the viewpoint of easiness of the system. However, when the protective layer is previously cured in a state wherein it is present in the intermediate transfer sheet to improve the durability as described above, the heat-meltability of the protective layer is markedly degraded resulting in poor selective transferability of the protective layer. The term "selective transferability", as used herein, refers to the property that only a heated portion of a transfer layer is transferred but unheated portions in the periphery of the heated portion are not transferred. As a result, in the transfer of the protective layer at the edge portion of character, there sometimes occurs a phenomenon that a heated portion of the protective layer is transferred together with an unheated portion adjacent to the heated portion (this phenomenon is referred to as "planar peeling"). In this case, it is necessary to make the protective layer thinner to obtain a satisfactory selective transferability and the thickness of the protective layer is limited to a relatively smaller one, resulting in failure to achieve high level durability.

In the case of curing the protective layer by irradiation with an ionizing radiation after the transfer, there are no such problems as mentioned above but there is another problem as follows: Generally ionizing radiation-curable resins have tackiness before curing. It is difficult to form a receptive/adhesive layer, which is provided to print a good image on the intermediate transfer sheet, onto the protective layer due to the tackiness of the protective layer, resulting in failure to obtain a satisfactory intermediate transfer sheet.

Patent reference 1: JP A 10-297122

It is an object of the present invention to provide an intermediate transfer sheet on which a satisfactory ink image is formed by a thermal transfer method using a thermal transfer sheet and which provides an image having excellent durability on a final receptor.

This and other objects of the present invention will become apparent from the description hereinafter.

SUMMARY OF THE INVENTION

The present inventors have made intensive researches to achieve the above-mentioned objects and discovered that in an intermediate transfer sheet for use in an intermediate transfer type thermal transfer recording method, comprising a support, and at least a protective layer and a receptive/adhesive layer laminated on the support in this order, the protective layer is mainly composed of an acryl-silica hybrid resin curable by irradiation with an ionizing radiation, resulting in satisfactory characteristics. Thus the present invention has been completed.

The present invention provides the following intermediate transfer sheets:

(1) An intermediate transfer sheet for use in an intermediate transfer type thermal transfer recording method, comprising a support, and at least a protective layer and a receptive/adhesive layer laminated on the support in this order, the protective layer comprising as a main component by weight an acryl-silica hybrid resin curable by irradiation with an ionizing radiation.

(2) The intermediate transfer sheet of (1) above, wherein the acryl-silica hybrid resin contains 15 to 60% by weight of a silica component and does not show tackiness at ordinary temperature before curing.

(3) The intermediate transfer sheet of (1) or (2) above, wherein the acryl-silica hybrid resin has a glass transition temperature of not less than 30° C. before curing.

(4) The intermediate transfer sheet of any one of (1) to (3) above, which further comprises an intermediate layer between the protective layer and the receptive/adhesive layer, the intermediate layer comprising a polyester urethane resin as a main component by weight.

DETAILED DESCRIPTION

The present invention will be explained in more detail.

The intermediate transfer sheet of the present invention has a fundamental structure wherein a protective layer and a receptive/adhesive layer are provided on a support in this order.

Any supports used in conventional thermal transfer sheets can be used as they are as the support for the intermediate transfer sheet of the present invention. Films or sheets which have been subjected to a treatment for improving adhesion against a layer to be provided thereon, and other materials can also be used. Thus, the support used in the intermediate transfer sheet of the present invention is not particularly limited.

Typical examples of the support include films of plastics or resins such as polyesters (e.g. polyethylene terephthalate (PET)), polycarbonates, polyamides, polyimides, cellulose acetate, polyvinylidene chloride, polyvinyl chloride, polystyrene, fluorine-containing resins, polypropylene, polyethylene and ionomers; paper sheets such as glassine paper, condenser paper and paraffin paper: and cellophane. Composite films wherein two or more these different material films are laminated to each other can also be used. When the intermediate transfer sheet of the present invention is used to transfer an image on a shaped plastics article, it is preferable that the intermediate transfer sheet of the present invention can be thermally deformed to conform to the profile of the shaped article. In this case, it is preferable to use a support easily susceptible to a thermal deformation such as easily shapable PET film or acrylic resin film. The thickness of such supports is appropriately varied depending upon the type of the material thereof to provide a suitable strength and heat resistance. Generally, however, the thickness is preferably in the range of 1.0 to 100 μm.

The protective layer which is a characteristic element in the present invention contains as a main component an acryl-silica hybrid resin curable by irradiation with an ionizing radiation.

The acryl-silica hybrid resin curable by irradiation with an ionizing radiation refers to a hybrid resin wherein one or more acrylic polymer chains containing at least one (meth)acryloyl group are introduced in particulated silica by chemical bond, preferably covalent bond. When the acryl-silica hybrid resin is irradiated with an ionizing radiation, e.g., ultraviolet ray, the (meth)acryloyl groups cause polymerization reaction to give a cured product wherein silica particles are uniformly dispersed in a crosslinked acrylic resin. The silica particles preferably have an average particle size of not more than 1 μm, especially not more than 0.1 μm. Examples of the ionizing radiation are ultraviolet ray, electron beam, and the like. Usually ultraviolet ray is preferred.

The content of the silica component in the acryl-silica hybrid resin is preferably 15 to 60% by weight, more preferably 20 to 30% by weight. When the content of the silica component is outside the above range, the film strength of the protective layer is low and the function as the protective layer is sometimes degraded.

The acryl-silica hybrid resin preferably does not show tackiness at ordinary temperatures before curing. In the case that the protective layer does not show tackiness, it is possible to form a transfer layer having a multi-layer structure. That is to say, it is possible to easily form on the protective layer a receptive/adhesive layer having a satisfactory printability in terms of thermal transfer printing.

The acryl-silica hybrid resin preferably has a glass transition temperature (Tg) of not less than 30° C. before curing. An acryl-silica hybrid resin having a glass transition temperature of less than the above range tends to show tackiness at ordinary temperatures.

The acryl-silica hybrid resin preferably has a weight average molecular weight of not less than 10,000, more preferably not less than 20,000. When the molecular weight of the acryl-silica hybrid resin is less than the above range, the hybrid resin tends to show tackiness before curing.

The content of the acryl-silica hybrid resin in the protective layer is preferably not less than 50% by weight, more preferably not less than 80% by weight. When the content of the acryl-silica hybrid resin is less than the above range, a desired durability is prone to not be obtained.

A photoinitiator and/or a sensitizer may be used together with the acryl-silica hybrid resin.

In order to improve the toughness and other properties of the protective layer, the protective layer may be further incorporated with (meth)acrylate oligomers or prepolymers each having at least one of acryloyl group and methacryloyl group, such as polyester (meth)acrylate, polyurethane (meth)acrylate, epoxy (meth)acrylate, silicone (meth)acrylate; polyenethiol resin; monofunctional monomers such as styrene; or polyfunctional monomers such as trimethylolpropane tri(meth)acrylate. However, since most of these (meth)acrylates are in liquid state before curing or viscous substances, it is necessary to add these (meth)acrylates in such an amount that the protective layer does not assume tackiness before curing.

The protective layer may be further incorporated with one or more thermoplastic resins other than the acryl-silica hybrid resin. Examples of the thermoplastic resins include acrylic resins, vinyl acetate resins, epoxy resins, polyester resins, polycarbonate resins, butyral resins, gelatin, cellulose resins, polyamide resins, vinyl chloride resins, and urethane resins. One or more other additives such as ultraviolet ray absorbents, coloring pigments, white pigments, body pigments, fillers, antistatic agents, antioxidants, fluorescent whitening agents and dyes can be used as required.

The thickness of the protective layer is preferably 0.1 to 10 μm, more preferably 0.5 to 5 μm. When the thickness is less than the above range, the function as the protective layer tends to be insufficient. When the thickness is more than the above range, the cost rises.

The receptive/adhesive layer used in the present invention has a function of satisfactorily receiving an ink image from a thermal transfer sheet and another function of showing satisfactory adhesion to a final image receptor when retransferring.

In the case that the thermal transfer sheet is a melt-transfer type thermal transfer sheet, it is preferable to use as the main resin component at least one selected from resins having a softening temperature of not less than 100° C. such as a styrene resin, an epoxy resin and an acrylic resin. If necessary, a resin having softness and good adhesion property such as polyurethane resin, polyester resin or olefin resin can be added to the receptive/adhesive layer to improve the adhesion against the final image receptor. Further, the receptive/adhesive layer may be incorporated with various fillers in order to prevent blocking or tack. Examples of the fillers are fluorine-containing resin particles, melamine resin particles, silicone resin particles, talc, kaolin, magnesium carbonate, potassium carbonate, titanium oxide, silica, and starch.

In the case that the thermal transfer sheet is a sublimation-transfer type thermal transfer sheet, it is preferable to use as the main resin component at least one selected from resins including polyester resins linear saturated polyester resins; vinyl chloride resins such as polyvinyl chloride and vinyl chloride/vinyl acetate copolymers; acrylic resins such as polyacrylic acid, polymethyl acrylate, poly-2-naphthyl acrylate, polymethacrylic acid, polyethyl methacrylate, polyacrylonitrile, and polymethacrylomethyl; and vinyl resins such as polystyrene, polyvinyl butyral, and styrene/butadiene copolymer. Further, the receptive/adhesive layer may be incorporated with one or more of the above-mentioned various fillers in order to prevent blocking or tack.

The receptive/adhesive layer preferably has a thickness of 0.1 to 10.0 μm. When the thickness of the receptive/adhesive layer is less than the above range, the adhesion to the final receptor tends to be lowered. When the thickness of the receptive/adhesive layer is more than the above range, the thermal sensitivity tends to be lowered.

In the present invention, it is preferable to provide an intermediate layer between the protective layer and the receptive/adhesive layer. The provision of the intermediate layer prevents a decrease in adhesion between the protective layer and the receptive/adhesive layer after the curing of the protective layer. It is preferable to use a polyester urethane resin as a main component in the intermediate layer. The intermediate layer may contain one or more other thermoplastic resins in addition to the polyester urethane resin. Examples of the other thermoplastic resins include acrylic resins, vinyl acetate resins, epoxy resins, polyester resins, polycarbonate resins, butyral resins, gelatin, cellulose resins, polyamide resins, vinyl chloride resins, and urethane resins.

The intermediate layer preferably has a thickness of 0.1 to 10.0 μm. An intermediate layer having a thickness of less than the above range tends to not provide a satisfactory adhesion between the protective layer and the receptive/adhesive layer after the curing of the protective layer. When the thickness of the intermediate layer is more than the above range, the selective transferability tends to be degraded.

In the case that the protective layer is hard to exfoliate from the support, a release layer may be provided between the support and the protective layer. The release layer can be formed by preparing a coating liquid containing at least one selected from waxes, silicone waxes, silicone resins, fluorine-containing resins, acrylic resins, polyvinyl alcohol resins, cellulose derivative resins, urethane resins, vinyl acetate resins, acrylic vinyl ether resins, maleic anhydride resins, and copolymers of two or more foregoing resins, and the like, applying the coating liquid by a conventional method such as a gravure coating method or a gravure reverse coating method, followed by drying.

The release layer can be appropriately selected from various types of release layers, for example, a type of release layer which is transferred onto a receptor at the time of thermal transfer, another type of release layer which remains on the support side at the time of thermal transfer, and still another type of release layer which undergoes cohesive failure at the time of thermal transfer. However, the type of release layer which remains on the support side at the time of thermal transfer is preferred since the interface between the release layer and the protective layer in the intermediate transfer sheet forms the top surface of the protective layer after thermally transferred, thereby providing good surface gloss of the protective layer transferred and stable transfer of the protective layer.

The coating thickness of the release layer is preferably about 0.5 to 5.0 μm on a dry basis. When a protective layer having a mat appearance is desired after transfer, means such as incorporation of various particles into the release layer, and subjecting the surface of the release layer on the side of the protective layer to a matting treatment can be adopted, thereby imparting a mat appearance to the surface of the protective layer transferred. In the case that the protective layer is easily peeled from the support, it is possible to peel the protective layer directly from the support by thermal transfer without providing the release layer.

Respective coating liquids for the above-mentioned layers can be incorporated with additives such as film-forming aid, coating liquid stabilizer, levelling agent and defoaming agent. Each layer can be formed by preparing a coating liquid (by dissolving or dispersing the materials constituting the layer into a suitable solvent) and applying it onto a support by a suitable coating method, followed by drying.

In the present invention, the formation of an ink image onto the intermediate transfer sheet can be carried out by means of a thermal transfer printer equipped with a thermal head using a thermal transfer sheet. The ink image formed on the intermediate transfer sheet is pressed against the a final image receptor under heating so that the ink image is transferred onto the final image receptor. The retransfer can be carried out by a method selected from various methods such as a method using a thermal transfer printer equipped with a thermal head, a hot roller method and a hot stamping method. The heating means for the retransfer is preferably a thermal head or a hot stamping device for the retransfer onto a portion of the final receptor and preferably a hot roller device for the retransfer onto the entire surface of the final receptor. The retransfer provides a final receptor having a thermally transferred ink image covered with a laminate comprising optionally release layer//protective layer//optionally intermediate layer//receptive/adhesive layer.

When an image is formed on an intermediate transfer sheet in accordance with the present invention by means of a thermal transfer printer, a high definition image is obtained. The image can be retransferred onto a final receptor with maintaining the high definition. The image obtained on the final receptor has high level durability which has never been obtained by use of the conventional intermediate transfer sheet.

The present invention will be more specifically described by way of Examples and Comparative Example. It is to be understood that the present invention is not limited to these Examples, and various changes and modifications may be made in the invention without departing from the spirit and scope thereof. In the following, the term "part" and "%" are represented in terms of weight basis unless otherwise noted.

1. Production of Thermal Transfer Sheet

A yellow ink was prepared by dispersing a yellow pigment into a solution of a vinyl chloride/vinyl acetate copolymer resin in an organic solvent. A magenta ink and a cyan ink were prepared in the same manner as above. The yellow ink was applied onto a front side of a 4.5 μm-thick PET film having a heat-resistant layer on the back side in a thickness of 0.5 μm after being dried by a gravure coating method, giving a melt-type yellow thermal transfer sheet. A melt-type magenta thermal transfer sheet and a melt-type cyan thermal transfer sheet were also produced in the same manner as above.

2. Production of Intermediate Transfer Sheet

Respective coating liquids mentioned below were applied onto a 25 μm-thick PET film as a support in the order of the protective layer coating liquid, the intermediate layer coating liquid and the receptive/adhesive layer coating liquid and dried so that the respective layers having a thickness shown in Table 1 were obtained. Thus, the intermediate transfer sheets of Examples 1, 2 and 3, and Comparative Example 1 were obtained.

| | |
|---|---|
| Protective layer coating liquid A | |
| UV curable acryl-silica hybrid resin (solid content: 30% (with the remainder being solvent), content of silica component: 23% on the basis of the solid content, Tg: 45° C., Mw: 20,000) | 70 parts |
| Photoinitiator (DAROCUR 1173, made by Ciba Speciality Chemicals K.K.) | 1.0 part |
| Sensitizer (UV634A, made by Seiko Advance Ltd.) | 0.6 part |
| Methyl ethyl ketone (MEK) | 30 parts |
| Protective layer coating liquid B | |
| UV curable acryl-silica hybrid resin (solid content: 30% (with the remainder being solvent), content of silica component: 20% on the basis of the solid content, Tg: 55° C., Mw: 25,000) | 70 parts |
| Photoinitiator (DAROCUR 1173, made by Ciba Speciality Chemicals K.K.) | 1.0 part |
| Sensitizer (Kayacure EPA, made by Nippon Kayaku Co., Ltd.) | 1.0 part |
| MEK | 30 parts |
| Protective layer coating liquid C | |
| Methacrylic acid methyl ester resin (Dianal BR80, made by Mitsubishi Rayon Co., Ltd.) | 20 parts |
| MEK | 80 parts |

-continued

| | |
|---|---|
| Intermediate layer coating liquid | |
| Polyester urethane resin (Vylon UR-3200, solid content: 30%, made by Toyobo Co., Ltd.) | 50 parts |
| Toluene | 50 parts |
| Receptive/adhesive layer coating liquid | |
| Styrene resin (softening point: 130° C.) | 5 parts |
| Epoxy resin (softening point: 110° C.) | 5 parts |
| Toluene/MEK (1/1 by weight) | 40 parts |

TABLE 1

| | Ex. 1 | Ex. 2 | Ex. 3 | Com. Ex. 1 |
|---|---|---|---|---|
| Protective layer | Protective layer coating liquid A 5 μm | Protective layer coating liquid B 5 μm | Protective layer coating liquid A 5 μm | Protective layer coating liquid C 5 μm |
| Intermediate layer | None | None | Intermediate layercoating liquid 0.5 μm | None |
| Receptive/ adhesive layer | Receptive/ adhesive layer coating liquid 1 μm | Receptive/ adhesive layer coating liquid 1 μm | Receptive/ adhesive layer coating liquid 0.5 μm | Receptive/ adhesive layer coating liquid 1 μm |

3. Evaluation of Characteristic Properties (1) Image Forming Property on Intermediate Transfer Sheet A full-color image was formed on the intermediate transfer sheet of Example 1, 2 or 3 or Comparative Example 1 using the following thermal transfer printer and the yellow, magenta and cyan transfer sheets mentioned above. The obtained images were evaluated by the naked eye.

Printer: Test printer, 300 dpi edge head, peel distance: 1.0 cm

Image pattern: Portrait (ISO/DIS 12640 registered image data)

Printing speed: 1 inch/second

Evaluation criteria

○: Satisfactory dot shapes are reproduced even in the case of minute dots.

X: Dropout of dots frequently occurs.

Retransfer condition

Each intermediate transfer sheet on which the image had been formed by the printing was hot-laminated on an acrylic resin plate of 10 cm in length×10 cm in width×2 mm in thickness by means of a hot laminator (made by Kabushiki Kaisha Taisei) at 150° C. and allowed to stand until the temperature decreased to room temperature, and the support was peeled off. The protective layer transferred together with the receptive/adhesive layer bearing the image on the acrylic resin plate was irradiated with UV rays of integrated light amount of 200 mJ/cm$^2$ by means of a conveyer type UV irradiation apparatus (CS 30 made by Japan Storage Battery Co., Ltd.) to cure the protective layer.

(2) Solvent Resistance

A drop of ethanol, MEK or toluene was dropped on the test piece (protective layer) and wiped off after 30 minutes to observe the state of the test piece.

○: No change.

Δ: The test piece (the image or acrylic resin plate) is somewhat damaged.

x: The test piece (the image or acrylic resin plate) is markedly damaged.

(3) Scratch Resistance

The test piece (protective layer) was rubbed ten times with steel wool (Bon Star #0000) at a load of 250 g/cm$^2$.

○: No change

Δ: Some scratches are made on the test piece (protective layer).

x: Scratches are markedly made on the test piece (protective layer).

(4) Adhesion Property 20 cross-cuts each having a size of 1.5 mm×1.5 mm were made on the test piece (protective layer) with a cutter knife and a peeling test was conducted using a cellophane tape (Nichiban CT-24).

◎: No cross-cut peeled

○: Ratio of peeled cross-cuts: less than 5%

Δ: Ratio of peeled cross-cuts: not less than 5%, less than 20%

X: Ratio of peeled cross-cuts: not less than 20%

The results of the evaluation above are shown in Table 2.

TABLE 2

| | Ex. 1 | Ex. 2 | Ex. 3 | Com. Ex. 1 |
|---|---|---|---|---|
| Image forming property | ○ | ○ | ○ | ○ |
| Ethanol resistance | ○ | ○ | ○ | ○ |
| MEK resistance | ○ | ○ | ○ | X |
| Toluene resistance | ○ | ○ | ○ | Δ |
| Scratch resistance | ○ | ○ | ○ | X |
| Adhesion | ○ | ○ | ◎ | ○ |

What is claimed is:

1. An intermediate transfer sheet for use in an intermediate transfer type thermal transfer recording method, comprising a support, and at least a protective layer and a receptive/adhesive layer laminated on the support in this order, the protective layer comprising as a main component by weight an acryl-silica hybrid resin curable by irradiation with an ionizing radiation.

2. The intermediate transfer sheet of claim 1 wherein the acryl-silica hybrid resin contains 15 to 60% by weight of a silica component and does not show tackiness at an ordinary temperature before curing.

3. The intermediate transfer sheet of claim 1 wherein the acryl-silica hybrid resin has a glass transition temperature of not less than 30° C. before curing.

4. An intermediate transfer sheet for use in an intermediate transfer type thermal transfer recording method, comprising a support, at least a protective layer, a receptive/adhesive layer laminated on the support in this order, and an intermediate layer between the protective layer and the receptive/adhesive layer, the protective layer comprising as a main component by weight an acryl-silica hybrid resin curable by irradiation with an ionizing radiation, the intermediate layer comprising a polyester urethane resin as a main component by weight.

* * * * *